United States Patent [19]

Michlmayr

[11] 4,039,432

[45] Aug. 2, 1977

[54] UPGRADING METAL-CONTAMINATED PETROLEUM OILS CONTAINING VANADIUM AND/OR NICKEL

[75] Inventor: Manfred J. Michlmayr, Walnut Creek, Calif.

[73] Assignee: Chevron Research Company, San Francisco, Calif.

[21] Appl. No.: 663,416

[22] Filed: Mar. 3, 1976

[51] Int. Cl.[2] ..... C10G 17/00; C10G 29/04

[52] U.S. Cl. ..... 208/252; 208/253

[58] Field of Search ..... 208/252, 253

[56] References Cited

U.S. PATENT DOCUMENTS

| | | | |
|---|---|---|---|
| 2,901,419 | 8/1959 | Brill | 208/253 |
| 3,459,658 | 8/1969 | Langlois et al. | 208/252 |
| 3,915,849 | 10/1975 | Zimmerman | 208/253 |

*Primary Examiner*—Delbert E. Gantz
*Assistant Examiner*—James W. Hellwege
*Attorney, Agent, or Firm*—D. A. Newell; R. H. Davies; D. L. Hagmann

[57] ABSTRACT

A petroleum oil containing, in parts by weight, at least 10 parts of vanadium and/or nickel per million parts of the oil is upgraded by contacting the oil in the liquid phase with an aqueous solution of at least one extraction agent of the group ferric salts soluble in acidified water and stannic chloride. The aqueous solution must have a pH at least sufficiently acidic to inhibit precipitation of the agent as hydroxide or basic salt.

10 Claims, No Drawings

UPGRADING METAL-CONTAMINATED PETROLEUM OILS CONTAINING VANADIUM AND/OR NICKEL

BACKGROUND OF THE INVENTION

This invention relates to the upgrading of a petroleum oil containing metallic contaminants by contacting the oil with an aqueous solution of ferric salts and/or stannic chloride.

In catalytic cracking, it has been known for sometime that certain metals, particularly vanadium and nickel, are very harmful to cracking catalysts. When deposited on cracking catalysts in concentrations of about 0.1 weight percent or less, such metals cause the production of extensive amount of coke and gas at the expense of valuable gasoline and heating oil fractions. This leads to a number of problems, including overloading of the regeneration and gas handling equipment and reducing the effective life of the catalyst and the like.

Metal contaminants also cause severe problems in hydrodesulfurizing hydrocarbon residua. The catalyst life is metals-limited in typical residua desulfurizing processes. Usually, metal contaminants reduce the life of the catalyst by as much as one-half compared to the case where the feed is free of these contaminants.

Vanadium and/or nickel is brought into a processing unit along with the other unfilterable metallic impurities present in the petroleum oil. Usually these impurities are metal salts of organic compounds, asphaltene-metal complexes, porphyrin-type metal complexes and the like normally present in petroleum oils. The substantial removal of these metal contaminants from petroleum oil is the concern of the present invention.

SUMMARY OF THE INVENTION

In the process of the present invention a metal contaminated petroleum oil having, in parts by weight, a content of said contaminant, calculated as metal, of at least 10 parts per million parts of the oil, in which the metal is selected from the group consisting of vanadium and nickel and a mixture thereof, is upgraded by reducing the metal content by contacting the oil in the liquid phase with an aqueous solution of at least one extraction agent selected from the group consisting of ferric salts soluble in acidified water and stannic chloride with the solution having a pH at least sufficiently acidic to inhibit precipitating the agent as hydroxide or basic salt.

EMBODIMENT OF THE INVENTION

In a preferred embodiment, a grossly metal-contaminated petroleum oil, for example, an atmospheric topped Arabian crude oil having a content, calculated as metal, of nickel and vanadium of about 50 ppm (the term "ppm" herein relates to parts by weight) is contacted with an aqueous solution which is about one molar in ferric chloride and about one molar in hydrogen chloride. The contacting is carried out using an ordinary rotary disk contactor operating at a level of 1–3 contact stages and at a temperature of about 93° C. The resulting mixture of aqueous solution and oil is thereafter passed to a settling zone for separation of the mixture into an oil phase and a water phase. The resulting oil phase is withdrawn from the settling zone, and, if desired, dried and freed of hydrogen chloride. The metal content of the resulting oil is substantially reduced, i.e., by at least 20%, and usually by as much as 50% or higher per extraction stage or the equivalent thereof.

CONDITIONS

A wide range of extraction conditions may be used in this process. Temperatures may range from about 0° C to 250° C and higher. A preferred temperature range is from 50° C to 180° C, more preferably 100° C to 150° C, with a most preferred operating temperature being at about 150° C. The freezing and boiling points of the aqueous solution of extraction agents will essentially determine the outer limits of the temperature range which can be employed. Where temperatures in excess of 100° C are used, pressure sufficient to maintain all constituents in the liquid phase will be required. These pressures may range from atmospheric to 2500 psig or higher. It is most convenient to use pressures of approximately 0–200 psig. At these pressures and at moderate temperatures substantial vanadium and nickel removal can be accomplished without the necessity of employing expensive or cumbersome high pressure extraction equipment. Contacting times, which in a flow system will be a function of the space velocity of the feed through the contacting vessel, should be sufficiently long to insure that all the vanadium-containing and nickel-containing compounds will be properly contacted by the extraction agent. In general, satisfactory contacting times can be from less than 1 minute to 2 hours or more. The optimum contacting time for any given feed will depend on the degree of metal-contamination of the oil, the reaction temperature, the volume ratio of oil to extraction medium (usually this ratio is in the range 1 to 0.5–10, respectively, and preferably 1 to 1–5), and the concentration of the agent in the aqueous extracting solution. At higher temperatures and with higher volumes of extracting solution and concentrations of agents, the contacting times will be shorter. Conversely, at lower temperatures or with less extracting solution and agent, contacting times will have to be longer in order to obtain a suitable vanadium and nickel removal. The optimum conditions for any given batch of oil within these ranges can readily be determined by one skilled in the art.

A wide variety of petroleum oils may be upgraded by this process. In general, these will be higher boiling oils, such as crude oils, residua, shale oils, topped crudes, and deasphalted oils, and similar materials which contain vanadium-containing contaminants, nickel-containing contaminants or both kinds. It is often desirable to subject the oil to some sort of fractionation process prior to removing vanadium or nickel or both in order to separate the lower boiling constituents of the oils. Because essentially all metal-containing organic compounds are of high molecular weight, high-boiling materials, it is apparent that these will be found among high-boiling oils. Thus, removal by distillation or some other separation process of the low-boiling fraction in a petroleum crude oil reduces the amount of material which must be contacted in this process. In some cases, as where the oil to be extracted is especially heavy and viscous, it may be desirable to have some solvent (diluent) present to facilitate the contacting of the oil with the aqueous extraction solution. Alternatively, where the use of relatively higher contacting temperatures will provide sufficient reduction in the viscosity of the oil, it is more desirable to use the elevated temperature without the addition of a light solvent. In other cases, it will be desirable to use a combination of solvent and high temperature in order to provide a more convenient contacting of especially heavy and viscous oils. Typical useful solvents are light paraffins or aromatics, such as propane, pentane or xylene, refinery cuts such as naphtha.

Chlorinated hydrocarbons, such as chloroform, can also be used to facilitate phase separation. Chloroform has a higher density than the extracting solution and mixes with the oil phase, increasing the density difference between the two phases, making separations easier. After phase separation, chloroform can be readily distilled from the oil phase.

The extraction solution used in the process of this invention is an aqueous solution containing at least one agent selected from the group consisting of ferric salts soluble in acidified water, and stannic chloride.

Aqueous solutions containing a solute comprising ferric salts and/or stannic chloride are suitable for use in the present process provided that the pH of the solution is sufficiently acidic to inhibit precipitation of these agents as hydroxides or basic salts. A satisfactory pH for this purpose varies depending upon the particular agent employed, its concentration in the aqueous solution and the contact temperature used. In general a pH of less than about 3 is sufficient to inhibit precipitation of the agent from the solution. Preferably the pH of the aqueous solution is in the range 1–2. Any suitable acid may be present in the solution to provide the desired pH. Excess acid may also be present. In general, in terms of the water and acid present in the solution, the solution should be dilute, that is, the acid content should be less than 50 weight percent thereof, and preferably less than 25weight percent.

Highly concentrated acid tends to promote undesirable sludge formation (see for example U.S. Pat. No. 2,427,589). Broadly, the aqueous extraction solution should contain sufficient acid to provide a pH of less than about 3, yet contain less than 50 weight percent of the acid, based upon the water and acids in the solution. Representative acids suitable for use herein include hydrochloric, nitric, sulfuric, hydrofluoric and the like mineral acids. Hydrochloric acid is preferred.

The concentration of the agent in the aqueous extraction solution may vary widely. For practical purposes, it must be at least 0.1 molar; preferably it is in the range 0.5 to 3 molar. Higher concentrations of the agent may be advantageously used in terms of ease of the oil-water phase separation, for example, up to about 5 molar and higher, because of the increased specific gravity difference between the phases. But as the relative amount of water becomes smaller corresponding to increased concentrations of the agent, a tendency to form undesirable sludge also may increase (see for example, U.S. Pat. No. 2,427,589). Broadly, agent concentrations in the range 0.1 to 5 molar contemplated for use herein. Where a mixture of ferric salt and stannic chloride is to be employed, the sum of the concentrations should be in the aforementioned ranges.

The following examples are for the further illustration of the invention. They are not, however, intended to limit the invention in any way.

EXAMPLES 1–10

Equal volumes of topped Safaniya crude oil (110° C+) and an aqueous extracting solution were contacted with efficient stirring for a period of about 0.5 hour at temperatures and concentration of extraction agents as listed in the Table below. The oil contained metal-containing impurities in the amounts 62 and 21 ppm (by weight and calculated as metal) of vanadium and nickel. The oil and water phase were separated by settling and the oil was analyzed using conventional methods. The results were as follows:

TABL I

Demetalation of Safaniya (110° C plus) Topped Crude

| Ex. No. | Agent | Conc. M | Contact Temp. ° C | V | Oil Analyses, Metal Content, ppm Ni |
|---|---|---|---|---|---|
| 1 | $FeCl_3$ | 0.5 | 21 | 42 | 18 |
| 2 | $FeCl_3$ | 0.5 | 49 | 40 | 20 |
| 3 | $FeCl_3$ | 0.5 | 65 | 18 | 22 |
| 4 | $FeCl_3$ | 0.1 | 21 | 46 | 18 |
| 5 | $FeCl_3$ | 0.05 | 21 | 58 | 18 |
| 6 | $SnCl_4$ | 0.5 | 21 | 52 | 15 |
| 7 | $SnCl_4$ | 0.5 | 93 | 50 | 4 |
| 8 | $FeCl_3$ | 0.5 | | | |
| | $SnCl_4$ | 0.5 | 21 | 46 | 13 |
| 9 | $SnCl_4$ | 0.5 | | | |
| | | 0.5 | 43 | 50 | 16 |
| 10 | $SnCl_4$ | 0.5 | | | |
| | | 0.5 | 93 | 37 | 15 |

Examples 1–5 show that $FeCl_3$ is effective, and quite selectively so, for vanadium removal from Safaniya crude oil; increasing the temperature and the $FeCl_3$concentration improves the extraction activity.

Examples 6–7 show the effectiveness and selectivity of stannic chloride for nickel removal from Safaniya crude oil at elevated temperatures.

Examples 8–10 show that mixtures of ferric and stannic chloride give no synergistic effect with Safaniya crude; in fact, they are not as effective as the equivalent amounts of the individual components by themselves. Thus, a vanadium removal step with ferric chloride followed by a nickel removal step with stannic chloride (or vice versa) is preferred to a one-step demetalization process with a mixed solution.

EXAMPLES 11–14

Example 1 was repeated except that the oil was a Venezuelan Boscan crude oil which had a metals content of vanadium and nickel of 1100 and 94 ppm, respectively, and the contact temperature was 99° C. The results are listed in Table II below.

TABLE II

Demetalation of Boscan Crude Oil

| Ex.No. | Agent | Conc. M | V | Oil Analyses, Metal Content, ppm Ni |
|---|---|---|---|---|
| 11 | $FeCl_3$ | 0.5 | 643 | 69 |
| 12 | $SnCl_4$ | 0.5 | 828 | 78 |
| 13 | $FeCl_3$ | 0.5 | | |
| | $SnCl_4$ | 0.5 | 452 | 52 |
| 14 | $SnCl_4$ | 0.5 | | |
| | | 0.5 | 689 | 65 |

Examples 11–14 show the effectiveness of both ferric and stannic chloride for vanadium and nickel removal from high metals content Boscan crude.

Examples 1–14 demonstrate that vanadium and nickel normally present as metal contaminants in crude oil, topped crude oil and the like oils are effectively removed from their oils by the process herein.

EXAMPLES 15–22

In these examples, equal volumes of heavy Arabian atmospheric residuum (340° C plus) and aqueous extracting solution were contacted for a period of 3 hours. This oil contained 80 ppm of vanadium, 25 ppm of nickel and 4 ppm of iron. The results are shown in Table III.

TABLE III

Demetalation of Arabian Heavy Residuum (340° C+)

| Ex. No. | Agent | Conc. M | Acid | Conc. Wt. % | Contact Temp. ° C | Product, Metal Content, ppm V | Ni |
|---|---|---|---|---|---|---|---|
| 15 | $FeCl_3$ | 1.0 | HCl | 10 | 65 | 35 | 15 |
| 16 | $FeCl_3$ | 1.0 | HCl | 10 | 25 | 61 | 20 |
| 17 | None | — | HCl | 10 | 95 | 81 | 24 |
| 18 | None | — | HCl | 25 | 95 | 75 | 25 |
| 19 | None | — | $H_2SO_4$ | 10 | 95 | 80 | 24 |
| 29 | None | — | $HNO_3$ | 10 | 95 | 72 | 23 |
| 21 | None | — | $CH_3COOH$ | 100 | 95 | 79 | 25 |
| 22 | $Fe(NO_3)_3$ | 1.0 | $HNO_3$ | 10 | 95 | 13 | 11 |

Examples 15, 16 and 22 demonstrate the effectiveness of ferric salts as agents for removing vanadium and nickel from nickel and vanadium-contaminated oils. Examples 17–21 show that the use of acid alone is relatively ineffective for removing metal contaminants. Surprisingly, (see U.S. Pat. Nos. 2,778,777and 3,095,368), aqueous solutions of acid alone are not effective for removing the vanadium and nickel contaminants. Ferric nitrate in nitric acid is very effective, as can be seen in Example 22. While nitric acid is useful for acidifying the aqueous solution, it caused some increase in the viscosity of the oil, presumably by promoting oxidation and/or polymerization of unsaturated components of the oil.

What is claimed is:

1. A process for upgrading a metal-contaminated petroleum oil having, in parts by weight, a content of said contaminant, calculated as metal in parts by weight, of at least 10 parts per million parts of the oil, said metal being selected from the group consisting of vanadium and nickel and mixtures thereof, which comprises reducing said metal content by contacting said oil in the liquid phase with an aqueous solution of at least one extraction agent selected from the group consisting of ferric salts soluble in acidified water and stannic chloride, said solution having a concentration of said agents in the range from about 0.1 to 5 molar and a pH at least sufficiently acidic to inhibit precipitating said agent, said contacting being at a temperature in the range from about 0° C to 250° C and at a pressure sufficient to maintain said solution in the liquid phase; and recovering the resulting oil having a reduced content of said metals.

2. A process as in claim 1 further characterized in that the contacting is at a temperature in the range from about 50° C to 180° C.

3. A process as in claim 1 further characterized in that the contacting is at a temperature in the range from about 100° C to 150° C.

4. A process as in claim 1 further characterized in that said pH is less than about 3.

5. A process as in claim 4 further characterized in that said pH is in the range from about 1 to 2.

6. A process as in claim 1 further characterized in that a viscosity reducing solvent is presentin said oil, thereby facilitating said contacting and subsequent oil separation.

7. A process as in claim 1 further characterized in that acid required to establish said pH constitutes less than 50 weight percent of the water plus acid present in the aqueous solution.

8. A process as in claim 7 further characterized in that said acid constitutes less than 25 weight percent.

9. A process as in claim 1 further characterized in that said agent is ferric chloride and hydrochloric acid is used to establish said pH.

10. A process as in claim 9 further characterized in that said agent is ferric chloride and said solution based upon water and acid present contain about 10 weight percent of hydrochloric acid, and in that for each of said oil about 1 volume of the aqueous solution are used.

* * * * *